US005894811A

United States Patent [19]

Nordby

[11] Patent Number: 5,894,811

[45] Date of Patent: Apr. 20, 1999

[54] SPRAY SHIELD FOR KAYAK

[76] Inventor: Willard E. Nordby, 5 Carmel Dr., Novato, Calif. 94945

[21] Appl. No.: 09/008,964

[22] Filed: Jan. 20, 1998

[51] Int. Cl.[6] ..... B63B 19/00

[52] U.S. Cl. ..... 114/347; 114/361

[58] Field of Search ..... 114/347, 361

[56] References Cited

U.S. PATENT DOCUMENTS 4,583,480 4/1986 Hamilton et al. ..... 114/347

*Primary Examiner*—Jesus D. Sotelo

*Attorney, Agent, or Firm*—Larry D. Johnson

[57] ABSTRACT

A spray shield apparatus for removable installation on the cockpit opening of a kayak or similar watercraft may include one or more inflatable cells that provide additional flotation to help prevent the kayaker from overturning, and semi-rigid curved vertical stays and a peripheral ring proximate its top so that it is "flared" out at the top (just below where it contacts the kayaker's torso) to better deflect waves and spray.

4 Claims, 3 Drawing Sheets

SPRAY SHIELD FOR KAYAK

BACKGROUND OF THE INVENTION

1. Field of the Invention

This invention relates generally to watercraft and accessories therefore, and more specifically to an improved spray skirt or shield apparatus for use on kayaks and similar watercraft.

2. Description of the Prior Art

Most kayaks utilize a spray skirt or shield device, which attaches at its bottom peripheral edge to the coaming of the kayak (around the circumference of the generally circular cockpit opening) with an elastic cord to form a more or less watertight seal, and at its top edge to the kayaker's torso or midsection (where it is typically tightened with a drawstring). Such a traditional spray skirt is useful for preventing water from entering the kayak's cockpit opening, but unfortunately still routinely permits water from waves, splash and spray to reach the kayaker's body. In addition, traditional kayak spray skirts do nothing to assist an overturned kayaker to right himself.

SUMMARY OF THE INVENTION

The spray shield for kayak of this invention provides an improved spray skirt or shield apparatus for removable installation on the cockpit opening of a kayak or similar watercraft. The inventive spray shield apparatus may include two key features: 1) the spray shield may incorporate one or a plurality of inflatable cell or bladder members that provide additional flotation to help prevent the kayaker from overturning; and 2) the spray shield may include semi-rigid curved vertical stiffeners or stays and a peripheral ring proximate its top so that it is "flared" out at the top (just below where it contacts the kayaker's torso) to better deflect waves and spray. This flared or "reverse curved" shape is also preferably at least partially achieved by the shape of the inflated cell(s).

DETAILED DESCRIPTION OF A PREFERRED EMBODIMENT

Figure 1:
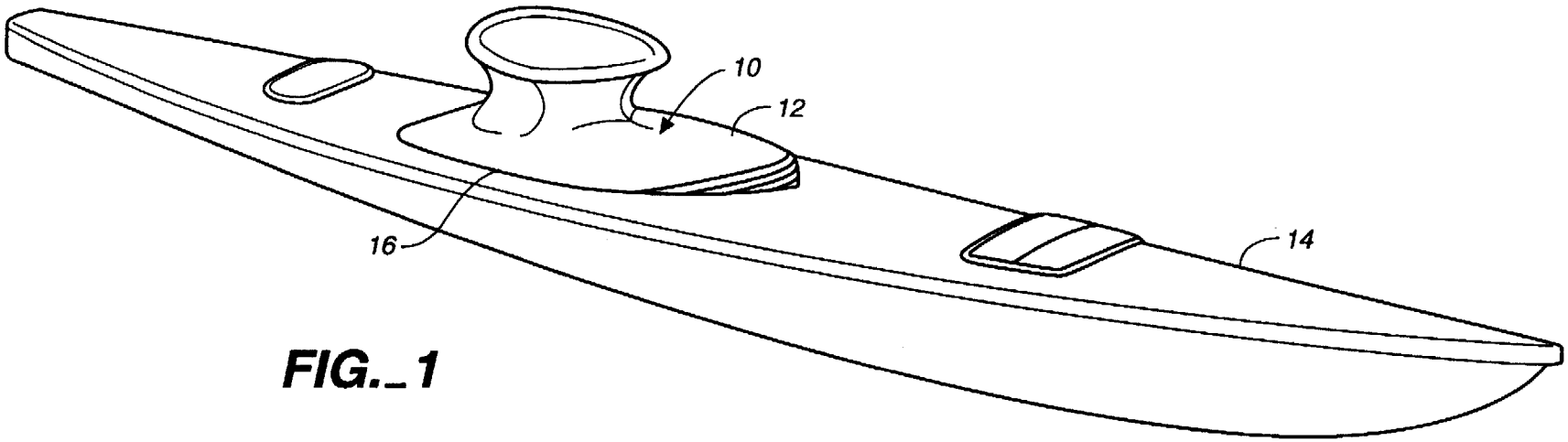
FIG. 1 is a perspective view of a spray shield apparatus of this invention as installed on the cockpit opening of a typical kayak.

FIG. 1 is a perspective view of a spray shield apparatus 10 of this invention as installed on the cockpit opening 12 of a typical kayak 14. The spray shield 10 is installed on the cockpit opening 12 by securing a cinch cord 16 or other elastic member on the perimeter of the base of the apparatus to a rim on the cockpit opening, as is well known in the art.

Figure 2:
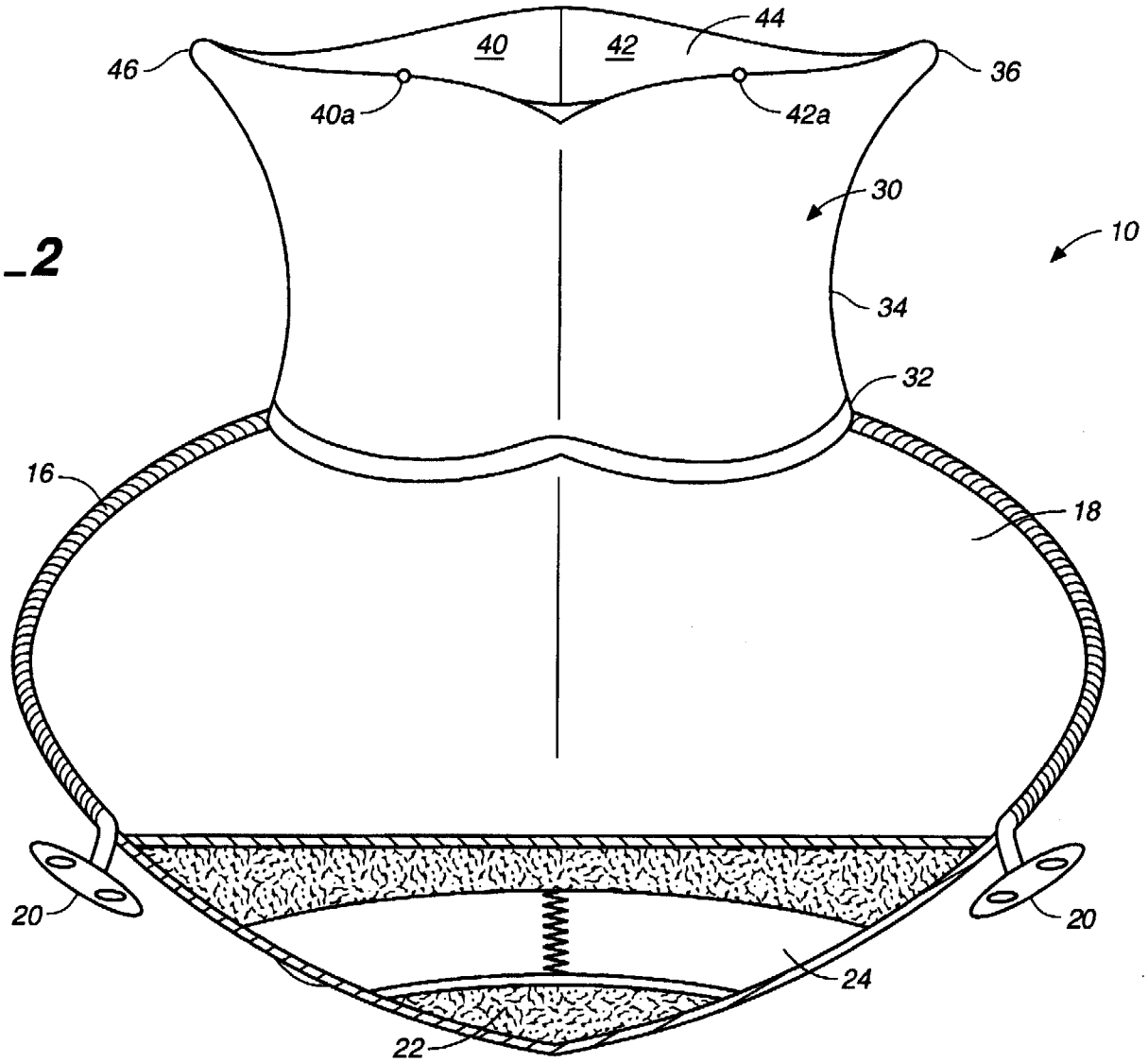
FIG. 2 is a front elevation view of a spray shield for kayak of this invention, illustrating a chimney portion having one or more inflation chambers and having an outwardly-flared top edge.

FIG. 2 is a front elevation view of a spray shield 10 of this invention, illustrating its component parts including shield cover 18 which serves to span the cockpit opening of the kayak, and is preferably made from one or more layers of waterproof fabric, neoprene, and/or other suitable material. Shield cover 18 includes bungee cinch cord 16 around its peripheral edge, which is adapted to engage a lip on the kayak's cockpit opening rim. A pair of bungee cinch handles 20 facilitate this installation. The front of shield cover 18 preferably includes a neoprene tip 22, and a quick-release handle 24, enabling the kayaker to pull the shield cover and spray shield off of the kayak so that the kayaker may easily exit the kayak in an emergency.

The spray shield 10 further includes a hollow cylindrical chimney portion 30 having a bottom portion 32, medial portion 34, and top portion 36, with bottom portion 32 secured to shield cover 18. Chimney portion 30 is preferably constructed from neoprene or coated nylon to form one or more inflation chambers 40, 42, having inflation valves **40*a*, 42*a*, and defining an opening 44 for the kayaker's torso. These inflation chambers are preferably shaped to have an outwardly-flared top edge 46, that is, be wider in cross-section at the top portion 36 than at the medial portion 34. This shape serves to deflect waves and spray from the kayaker when in use. Furthermore, the relative buoyancy provided by the flotation chambers 40, 42 serves to assist the kayaker to right himself in the event of overturning. The location of these flotation chambers 40, 42** above the waterline does not interfere with kayaking, and produces no water resistance. In addition, the chambers may be only partially inflated (or deflated) to enable the user to "tune" the chimney and its flotation to the prevailing conditions.

Figure 3:
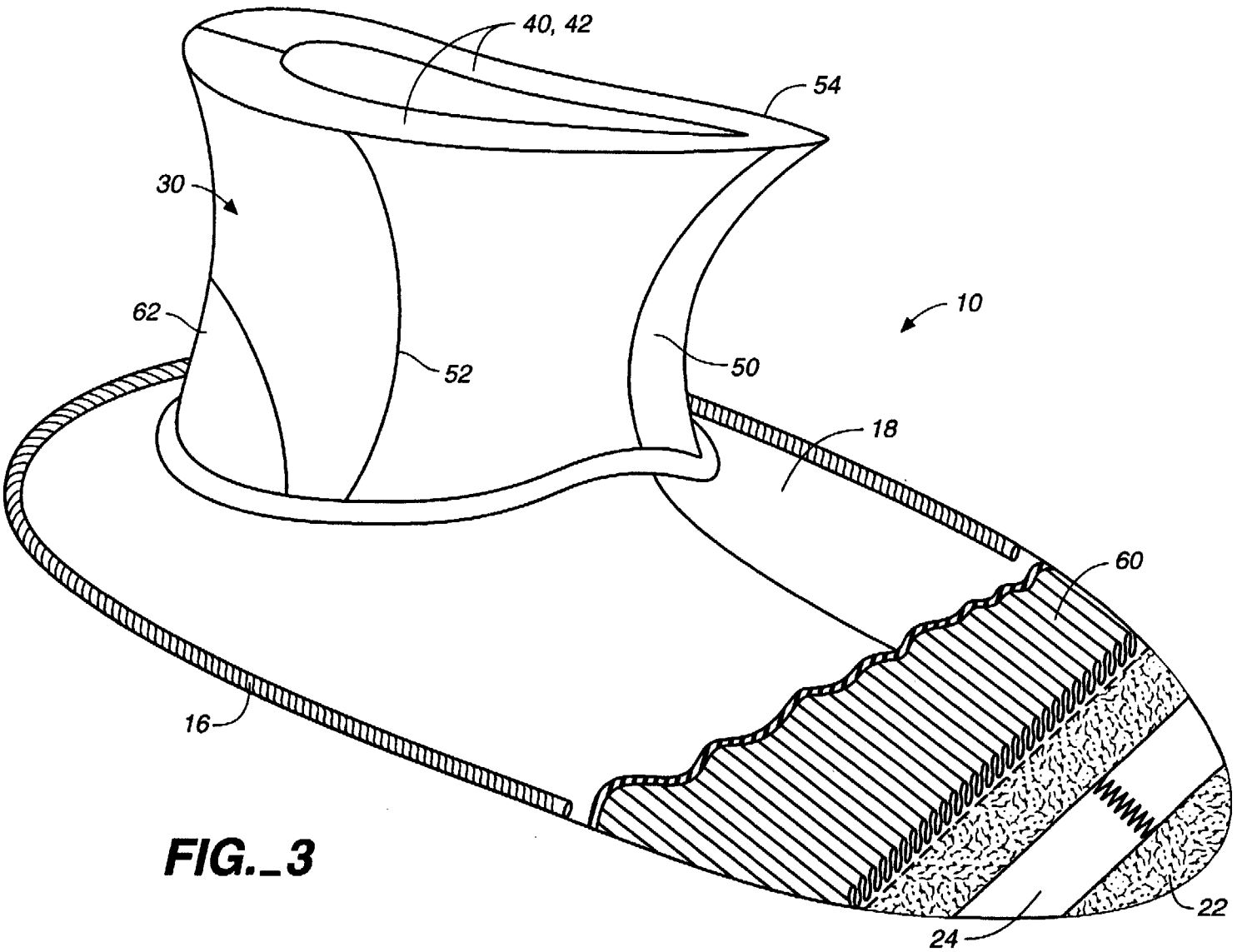
FIG. 3 is a partially cutaway right front quarter perspective view of a spray shield of this invention, again illustrating the chimney portion and inflation chambers having an outwardly-flared top edge, and further illustrating rigidifying curved vertical stays and a peripheral ring portion incorporated on the chimney portion top edge.

FIG. 3 is a partially cutaway right front quarter perspective view of a spray shield 10 of this invention, again illustrating the chimney portion 30 and flotation chambers 40, 42 having an outwardly-flared top edge, and further illustrating a plurality of curved vertical stays 50, 52 and a rigidifying peripheral ring portion 54 on the chimney portion 30 top edge. These curved vertical stays 50, 52 and rigidifying ring portion 54 may be used instead of, or in conjunction with, the shape of the flotation chambers, to provide the desired flared shape. A flange made of rubber or other material may extend inwardly from the ring portion to be cinched or otherwise secured adjacent the user's torso. In addition, forward vertical stay 50 serves to "peak" the shield cover in front of the kayaker, to better deflect waves and spray and prevent pooling of water on the spray shield.

This view further illustrates the construction of the shield cover 18, which may include skirt baffle portion 60. This baffling provides loft between the layers of the shield cover, to help enable ventilation and to prevent condensation. A lumbar pad 62 may be incorporated into the back side of chimney 30, and be constructed of closed-cell foam or similar material. This lumbar pad not only provides back comfort to the kayaker, but also may add form and structure to the flared shape of the chimney.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed as invention is:

1. A spray shield apparatus for installation on the cockpit opening of a kayak, said spray shield apparatus comprising:

a shield cover portion adapted for releasable engagement to and to generally span the cockpit opening of the kayak; and a hollow cylindrical chimney portion having a bottom portion, a medial portion having a width, and a top portion having a width, said bottom portion secured to said shield cover, and said top portion width greater than said medial portion width so that said chimney portion is flared out at the top portion, said chimney portion constructed from one or more inflation chambers forming an opening for a kayaker's torso.

2. The spray shield apparatus of claim 1 wherein said chimney portion includes semi-rigid curved vertical stays.

3. The spray shield apparatus of claim 1 wherein said chimney portion includes a peripheral ring proximate said top portion so that it is flared out at said top portion.

4. The spray shield apparatus of claim 1 wherein said chimney portion includes a lumbar pad.

* * * * *